United States Patent [19]

Burkett

[11] 3,985,256

[45] Oct. 12, 1976

[54] EGG FILLER FLAT

[75] Inventor: Francis L. Burkett, Breckenridge, Mich.

[73] Assignee: The Dow Chemical Company, Midland, Mich.

[22] Filed: Sept. 24, 1973

[21] Appl. No.: 400,279

Related U.S. Application Data

[63] Continuation of Ser. No. 101,884, Dec. 28, 1970, abandoned.

[52] U.S. Cl. ..... 217/26.5

[51] Int. Cl.[2] ..... B65D 81/16; B65D 85/32

[58] Field of Search ..... 217/26.5, 27; 229/2.5, 229/29 M

[56] References Cited

UNITED STATES PATENTS

| | | | |
|---|---|---|---|
| 2,971,685 | 2/1961 | Treida | 229/2.5 |
| 3,334,765 | 8/1967 | Modersohn | 217/26.5 |
| 3,420,395 | 1/1969 | Boyd et al. | 217/26.5 |
| 3,424,363 | 1/1969 | Donovan | 229/2.5 |
| 3,675,806 | 7/1972 | Noguchi | 217/26.5 |

*Primary Examiner*—Leonard Summer
*Attorney, Agent, or Firm*—Arthur J. Young

[57] ABSTRACT

A highly flexible egg filler flat comprising a plurality of downwardly directed deep egg receiving pockets or cells grouped around upwardly tapering hollow support posts which terminate in a transverse top wall is disclosed. The individual cell is defined by a side wall which forms a hollow cone shape having a transverse bottom wall. The cells and support posts are interconnected by inverted V-shaped saddle formations to provide lateral support for the eggs positioned in each cell. The lowest most point of the saddle formations is substantially above a horizontal plane defined by the terminal ends of the outer peripheral edges of the flat. The outer peripheral edges comprising two opposing substantially continuous flanges directed upwardly and outwardly from the bottom of the cells adjacent the edge of the flat and two opposing substantially continuous flanges directed downwardly and outwardly from the top of the support posts adjacent the edge of the flat. The upwardly and outwardly directed flanges have indented handle grip areas. The combination of the peripheral edge flanges and the saddle formations interconnecting the support posts and cells contribute to make a highly flexible egg filler flat which provides superior egg protection due to the formation of a hyperbolic paraboloid configuration of the flat when it is loaded with eggs and supported at the handle grip areas.

5 Claims, 9 Drawing Figures

Fig. 8
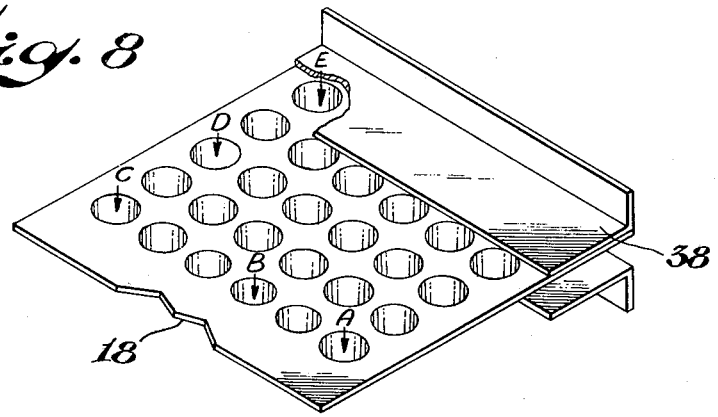
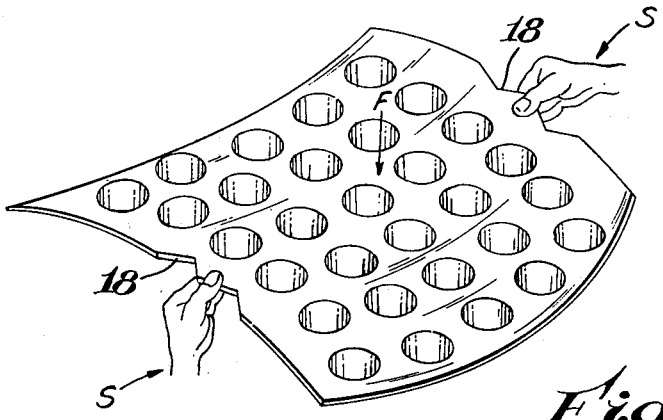
Fig. 9

EGG FILLER FLAT

CROSS REFERENCE TO RELATED APPLICATION

This is a continuation of application Ser. No. 101,884, filed Dec. 28, 1970, now abandoned.

BACKGROUND OF THE INVENTION

1. Field of the Invention

This invention relates to egg filler flats used in cases or crates for bulk storage, handling and shipping of eggs and the like, and is more particularly related to improvements which include means for not only providing maximum protection of eggs during rough packing and handling, but also includes means whereby the flats may be easily inserted or removed from egg cases or crates.

2. Description of the Prior Art

In general, eggs and like articles are packed for shipment in corrugated cases, wire baskets or wooden crates in which wood fiber pulp or foamed thermoplastic egg filler flats are used with each filler flat having cells or pockets for receiving the individual eggs. The filler flats separate the several layers of eggs packed within the cases or crates. Normally, the filler flats have thirty cells in a five by six cross row relationship confined within a substantially square egg flat configuration. Egg crates or cases are usually designed to hold fifteen dozen or thirty dozen eggs in one six egg-layer grouping or in two, side by side, six egg-layer groupings, respectively.

In the past, egg filler flats were usually made from a composition of molded pulp, but more recently egg flats have been made from thermoplastic materials. When molded pulp is utilized, the egg flats are mass-produced on machines carrying suction molds which are passed through a suspension or slurry of fibers whereby the fibers are deposited in the form of a felt layer on the surface of the molds. Thereafter the felt layer is dried to form the egg flat. The deposited fibers generally provide an acceptable softness and resilience, but the requisite strength, cell capacity, etc. is achieved through the use of special structural components and design of the egg filler flat. When a thermoplastic material is utilized the egg flats are normally mass-produced by thermoforming thermoplastic sheeting on vacuum or matched die forming machines. A foamed thermoplastic material, more particularly polystyrene foam sheet, is normally used to provide for a suitable softness and resilience, but as in the case of using a molded pulp material the requisite strength, cell capacity, etc. is achieved primarily through the design of the egg flat.

In the past, a primary problem has been the incorporation of a soft resilient material into an egg flat which will also provide sufficient rigidity to prevent the eggs from contacting each other and breaking during rough handling of the individual flats. The problem of providing sufficient rigidity in the egg flats has resulted in a variety of designs to overcome the economic disadvantage of using an excess of structural material. Also, an additional problem is created by increasing the rigidity in an egg flat in that it becomes increasingly difficult to load and unload the filler flats from the egg crates or cases as the rigidity of the egg flats is increased.

SUMMARY

In general, the present invention provides an egg filler flat useful for the bulk packaging and handling of eggs or the like. The unitary structure of the egg flat is molded of fibrous wood pulp material or thermoformed from a thermoplastic material such as a polystyrene foam sheet. Although molded pulp can be an economical material to use for the present invention, a thermoplastic foam material such as polystyrene foam is preferred because its use overcomes a difficult denesting problem in production line operations associated with the uneven rough outer surface of all moled pulp egg filler flats.

Generally, egg flats are used only one time and then discarded, but if a thermoplastic foam egg flat is used as herein described it may be desirable and beneficial to reuse the egg filler flats several times. In this case, a cleaning operation may be required before each reuse to remove soiling and contamination. Since high temperature water may be employed for cleaning, conventional polystyrene foam egg filler flats may warp adversely due to their low heat distortion temperature. To overcome this heat distortion problem, such materials as a styrene maleic anhydride copolymer having a maleic anhydride component of 10 to 40 weight percent may be used. Beneficially, a copolymer of styrene maleic imide, polychlorostyrene, and a polystyrene that has been lightly cross-linked with 0.01 to 0.7 mole percent divinyl benzene may also be used to overcome a heat distortion problem.

The present invention of an egg flat comprises a plurality of downwardly deposed deep receiving pockets or cells grouped around upwardly tapering hollow support posts which are terminated by a transversed top wall and which extend above a horizontal plane defined by the lowest most point of saddle formations that separate the individual adjacent cells and converge into and interconnect with the adjacent support posts near their transverse top wall. The saddle formations provide lateral support for the eggs positioned in each cell. The individual cell or pocket is defined in part by a side wall which flares upwardly and outwardly around a spaced vertical center line in a cone-shaped configuration and may be geometrically described as being formed by revolving a right triangle about a spaced vertical axis. The bottom of the cone-shaped cell is terminated by a transverse bottom wall. A smooth continuation of the top of the cell side wall converges into the side wall of adjacent support posts and the saddle formations separating the adjacent cells.

It is understood that the egg flat herein described is substantially square or rectangular in planar outline to conform with the standard box like egg cases or crates commonly used. The egg filler flat has outer peripheral edges comprising two opposing substantially continuous flanges directed upwardly and outwardly from the bottom edge of the egg filler flat and two opposing substantially continuous flanges directed downwardly and outwardly from the top edge of the egg filler flat. The lateral ends of the flanges are connected at the corners of the egg filler flat. The upwardly and outwardly directed flanges have indented handle grip areas. The terminal outer edge of all of the flanges is positioned substantially below a plane which defines the lower most point of the saddle formations. The plurality of cells are positioned within the flat in a five by six cross-row configuration, but this invention is not to be construed as limited by the number of cells or number of rows of cells described herein.

Novel features of the invention described above reside in the peripheral edge flanges, the saddle formations interconnecting the support posts and a high flexibility attributed to the structural design of the egg flat which is a relative contradiction to the rigid egg flat characteristics previously considered necessary by persons skilled in the art. If the above features of the present invention are used in combination, the egg flat will conform to the geometric shape of a hyperbolic paraboloid when loaded with eggs and then supported at the handle grip areas in two opposing peripheral edges.

The advantage in the loaded hyperbolic paraboloid egg flat configuration is readily understood by making a comparison between the egg flat herein described and other relatively rigid egg flats available. When other rigid egg flats are loaded and supported by the handle grip areas in two opposing edges, the egg flat forms a simple arc in the horizontal or planar direction of the supported handle areas and thus causes the eggs in the rows running parallel with the arc to come in contact with each other. If the contact pressure between the eggs is sufficiently high, the egg shells may be cracked or broken as would be the case when the loaded egg flats are roughly handled. When a hyperbolic paraboloid configuration occurs in the supported egg filled flat, as is the case in the present invention, the direction of the deflection of the eggs is changed by the compound curvature of the flat and thus do not readily contact one another or only contact with a light pressure. Rough handling will only tend to separate the individual eggs more instead of bringing them together as is the case in a rigid egg filler flat because the compound curvature will be increased outwardly. The degree of compound curvature in the egg filled hyperbolic paraboloid egg filler flat herein described is limited only by the necessary edge rigidity required to prevent the eggs in the cells adjacent to the peripheral edge from falling out.

The substantially continuous peripheral edge flanges of the present invention provide two functions. First, the flanges provide vertical compressive and tensile strength along the edges of the egg flat which prevents the outer edge curvature of the loaded egg flat forming a hyperbolic paraboloid configuration from becoming so great that eggs adjacent to the edges of the flat can fall out. Second, the flanges deflect from the interior of the egg flat when it is loaded with eggs and supported at the handle areas such that they do not impede the stretch or flexibility of the egg flat in the horizontal or planar directions within the flat. The importance of the egg flat stretching or flexing within the horizontal directions thereof is readily apparent when it is understood that planar structures cannot form the compound curvature of a hyperbolic paraboloid unless there is substantial deformation within the horizontal directions of its structure, i.e., rigid structures will not readily deform to a hyperbolic paraboloid configuration.

The saddle formations between adjacent cells of the egg flat also contribute to the highly flexible design characteristics of the egg flat. The inverted V-shaped cross-sectional construction of the saddle formations provides for sufficient lateral support between the egg cells without effectively reducing the overall horizontal design flexibility of the egg flat. Also, it has been found that the ratio of the height of the lowest point of the upper surface of the saddle formations to the total height of the egg flat is a predominant variable in the structural design flexibility of the flat and should be about 0.7 or greater.

Accordingly, this invention has among its objects the provision of a highly flexible egg filler flat useful for the bulk packaging, handling, storage and shipment of eggs or like articles wherein maximum protection from breakage is desirable. Another object of the present invention is to provide a highly flexible egg filler flat that can be easily inserted and taken out of egg cases or crates when it is filled with eggs or like articles. A further object of the present invention is to provide a highly flexible egg filler flat that prevents jamming of the trays when they are nested one within the other for storage and shipment or denesting from automatic equipment. A still further object of the present invention is to provide a highly flexible egg filler flat with an improved peripheral edge, lateral support saddle formations between adjacent cells and a high flexibility design which will form a hyperbolic paraboloid configuration when filled with eggs or like articles and supported by handle grip areas on two opposing edges thereof.

BRIEF DESCRIPTION OF THE DRAWINGS

Additional objects and advantages of the present invention are even more apparent when taken in conjunction with the accompanying drawings in which like characters of reference designate corresponding material and parts throughout the several views thereof, in which:

FIG. 8 is an essentially diagrammatic view representing how an egg filler flat, without structural details of the flat being shown, was held for testing the flexibility of the structural design and also where the loading points are located for the flexibility matrix obtained; and FIG. 9 is an essentially diagrammatic view representing the hyperbolic paraboloidal configuration of an egg filler flat, in accordance with this invention but without structural detail of the flat as shown in FIGS. 1–6, when the cells thereof are filled with eggs or like articles.

DESCRIPTION OF THE PREFERRED EMBODIMENTS

The following description illustrates the manner in which the principles of the invention are applied but are not to be construed as limiting the scope of the invention.

More specifically, it will be understood that the egg filler flat of this embodiment is a substantially square or rectangular sheet of thermoplastic polystyrene foam which is generally mass-produced on a thermoforming machine from a foam sheet having a thickness ranging from about 50 to 200 mils. The egg filler flat produced will weigh from about 20 to 40 grams and will vary from about 40 to 120 mils in thickness.

The egg filler flat to be presently described in detail is that of the type conventionally described as a 5 × 6 filler flat, i.e., will hold 30 or 2½ dozen eggs. Inasmuch as the cells and other cooperating portions of the filler flat are substantially uniform throughout the flat, only one of each of the cooperating parts will be described in detail.

Figure 1:
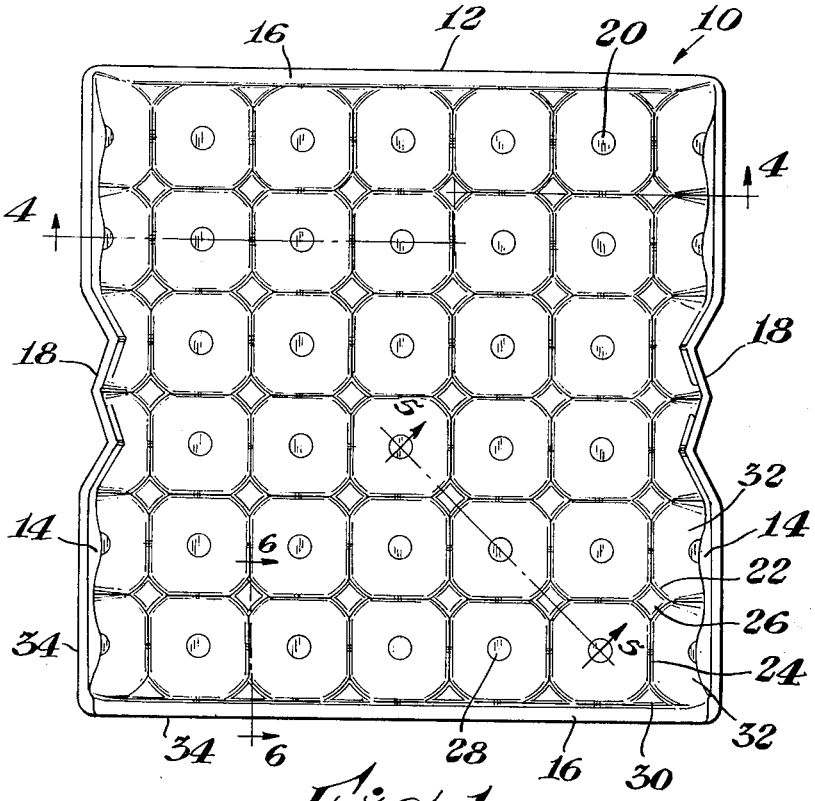
FIG. 1 is a plan view of an egg filler flat embodying the features of the invention.

The egg filler flat is indicated generally at 10 in FIG. 1 and comprises a one piece body member 12 produced from a single sheet of polystyrene foam and having peripheral marginal flanges 14 and 16 substantially bordering all sides thereof with the exception of indented handle grip areas 18 on the opposing sides including the flanges 14. The flanges 14 and 16 are interconnected at the corners of the egg filler flat 10. The flanges 14 are substantially continuous, interconnect with the body member 12 near the bottom thereof as more clearly illustrated in FIG. 4, and directed upwardly and outwardly at an angle of about 12° from the vertical direction thereof. The peripheral flanges 16 are substantially continuous, interconnected with the body member 12 near the top thereof as more clearly illustrated in FIGS. 2 and 3, and directed downwardly and outwardly at an angle of about 12° from the vertical direction thereof. The flanges 14 and 16 provide vertical compressive and tensile strength at the peripheral edges of the egg filler flat 10 without substantially impeding the flexibility of the body member 12 in the horizontal directions thereof.

The body member 12 includes a plurality of pockets or cells indicated generally at 20 produced in rows extending crosswise and lengthwise of the sheet, equally spaced apart from one another and forming a regular pattern. Between the cells 20 there are provided projections or hollow support posts indicated generally at 22 which follow a similar pattern. The support posts 22 are interconnected by horizontally disposed and circumferentially spaced saddle formations 24 disposed at 90° intervals. The support posts 22 are terminated with a transversed top wall 26 and the cells 20 are terminated with a transverse bottom wall 28.

Figure 2:
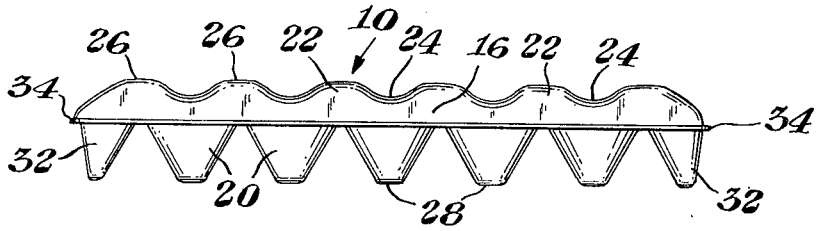
FIG. 2 is an end elevation showing the lower edge of FIG. 1.
Figure 3:
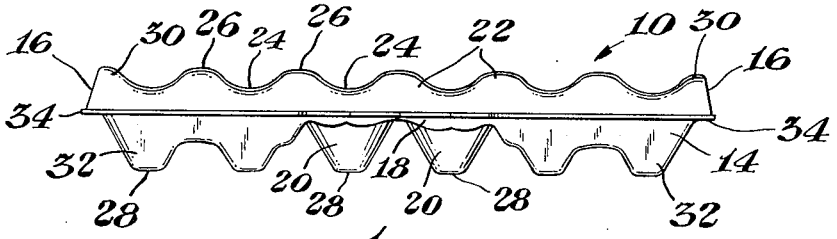
FIG. 3 is a side elevation showing the left edge of FIG. 1.

Like reference numerals for the various components shown in FIG. 1 are also shown in the side elevations of the filler flat 10 of FIGS. 2 and 3 to better illustrate the overall design of the egg filler flat 10. Details of the flanges 14 and 16, cells 20, support posts 22 and horizontally disposed saddle formations 24 will be subsequently described, particularly with respect to FIGS. 4–6. In the five by six filler flat 10, six support posts 22 in a row extend in one direction and five support posts in a row extend opposite thereto. Half posts shown at 30 in FIG. 1 are provided adjacent both ends thereof and in the direction which the five posts in a row extend. Additionally, as indicated at 32, half cells are formed at opposite ends of the filler flat 10 in the direction which a row of five cells appear. The half posts 30 and the half cells 32 will not be described in detail.

Referring to FIGS. 3–6 and particularly considering the horizontally disposed saddle formations 24, it will be noted that the saddles 24 have generally what can be described as an inverted V shape. The upper surfaces of the saddles 24 curve smoothly upward from their lowest point to interconnect with and converge into the support posts 22 near the transverse top wall 26 thereof. The lowest point of the saddles 24 defines a horizontal plane which is substantially above the outer terminal edge 34 of the peripheral edge flanges 14 and 16. The ratios of the height of the lowest point of the saddles 24 to the total height of the egg filler flat 10 in one specific example of this invention is 0.84 which is substantially greater than like ratios for designed lateral support members between support posts found in other egg filler flats available, which values are shown in Table I below.

TABLE I

| Egg Filler Flat Examples | A[1] | B[2] | Ratio — B/A |
|---|---|---|---|
| 1[3] | 1.87 | 1.56 | 0.84 |
| 2 | 1.88 | 1.13 | 0.60 |
| 3 | 1.88 | 1.16 | 0.62 |
| 4 | 1.78 | 1.13 | 0.63 |
| 5 | 1.94 | 1.03 | 0.53 |
| 6 | 1.85 | 0.97 | 0.52 |
| 7 | 2.00 | 1.06 | 0.53 |

[1]Total Height of Egg Filler Flats in inches.
[2]Height of lateral support members between posts of the Egg Filler Flats from their base in inches.
[3]Egg Filler Flat example of the present invention.

The inverted V-shape of the saddles 24 provide sufficient lateral support between the cells 20 without impeding the design flexibility of the egg filler flat 10. It has been further found that the saddle height ratio to the total height of the filler flat 10 substantially influences the design flexibility of the filler flat 10 and should be maintained at a ratio of about 0.7 or greater.

Figure 5:
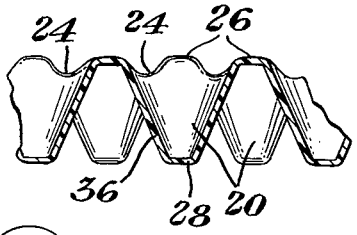
FIG. 5 is a fragmentary section taken along reference line 5—5 of FIG. 1, showing more specific details, and the configuration of one of the egg filler flat cells.

The side walls of the support posts 22 project above a horizontal plane defined by the lowest most point of the saddle formations 24 and are a smooth continuation of the side walls 36 of the cells 20 and the saddle formations 24, as best illustrated by FIG. 5. The cells 20, also illustrated in FIG. 5, are defined by the upwardly and outwardly directed side wall 36 forming a coneshaped configuration and the transverse bottom wall 28. The cells 20 can best be described geometrically as a true frustum of a cone generated by rotating a right triangle of about 24° around a spaced vertical axis.

Figure 4:
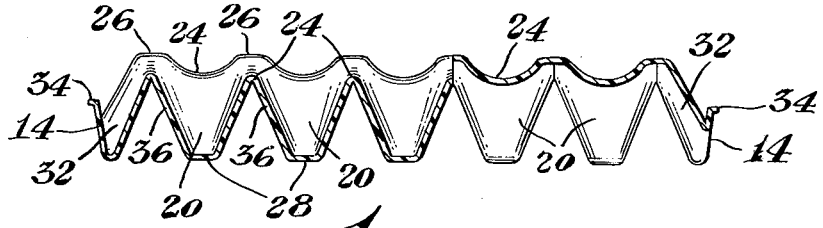
FIG. 4 is a vertical section taken along reference line 4—4 of FIG. 1.
Figure 6:
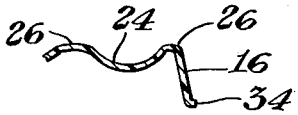
FIG. 6 is a fragmentary section taken along reference line 6—6 of FIG. 1, showing details of the novel top flange construction.

Referring to FIGS. 4 and 6, the peripheral edge flanges 14 and 16 are substantially continuous and provide vertical tensile and compressive strength sufficient to prevent eggs falling from the egg filler flat 10 without substantially impeding the horizontal design flexibility within the egg filler flat 10. The deep substantially continuous design of the flanges 14 and 16 is required to provide the needed vertical peripheral edge support.

Figure 7:
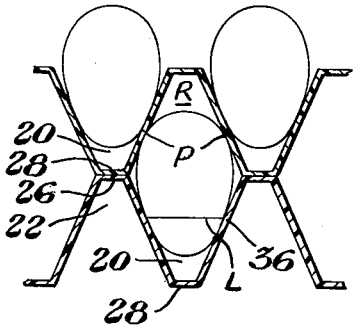
FIG. 7 is an essentially diagrammatic fragmentary view showing a pair of egg filler flats in juxtaposed relation wherein the upper flat has been rotated 90° and is juxtaposed on the lower flat for illustrating the egg-receiving cells of the bottom flat and the corresponding egg-receiving portions afforded by the undersurface of the upper flat.

Referring to FIG. 7, an egg filler flat of the diagrammatic character shown in FIG. 1 will receive eggs in the cells thereof and a second like filler flat will be positioned thereon. However, the second filler flat will be rotated 90°, i.e., the handle grip areas 18 will be positioned 90° with respect to each other on the respective egg filler flats, as is conventional. When the egg filler flats are so orientated, the under surface of the transverse bottom wall 28 of the cell 20 of the top egg filler flat will be received on the upper surface of the transverse top wall 26 of the support post 22 of the bottom egg filler flat, thus allowing for the transfer of a major portion of the load through the juxtaposed filler flats rather than the eggs when the filled egg flats are positioned in an egg case or crate. Also, as illustrated in FIG. 7, eggs are conventionally packed small end down and will be received in the egg receiving spaces R between the egg filler flats. Thus, because of the cone-shaped configuration of the cells 20, there is provided a full circumferential resilient line L of contact between the eggs and the side walls 36 of the cells 20. Additionally, the undersurfaces of the side walls 36 of the cells 20 of the upper egg filler flat will provide four contact points P to maintain the eggs in a relatively fixed position and prevent them from rattling in the egg receiving spaces R of cooperating egg filler flats.

As previously noted, a high structural design flexibility of the egg filler flat is an important feature of the present invention. If sufficient flexibility has not been designed into an egg filler flat, it has been found that it will not exhibit enough elastic behavior in the horizontal directions within the flat to form the hyperbolic paraboloid configuration of the present invention when the flat is loaded with eggs and supported at the handle grip areas. FIG. 9 is a diagrammatic illustration, in accordance with the present invention but without the structural detail shown in FIGS. 1–6, of the hyperbolic paraboloidal configuration which occurs when a fully distributed egg loading force F is applied to the egg filler flat and the flat is supported at the handle grip areas 18 as shown at S. The practical utility of forming this configuration is that maximum protection against breakage is achieved. An increase in the egg loading force, both static and kinetic, does not reduce the protection afforded individual eggs since the result will be only to increase the compound curvature of the resulting configuration.

A standard method of representing the elastic response of a structure subjected to multiple point loading was used to test and define the structural design flexibility of the present invention. The standard method results in what is normally termed a flexibility matrix, which is described in the Handbook of Engineering Mechanics, Sec. 63-9, W. Flugge, First Ed. (1962), McGraw-Hill Book Company, Inc. The components of such a matrix provides the deflection at a specified point which results from a unit load applied at a given location. Thus, $f_{ij}$ is the deflection at the $i$ location which results from a unit load applied at the $j$ location. The flexibility matrix is symmetric with the exception of experimental errors that occur during testing. The performance of an egg filler flat can be measured by the flexibility matrix and is dependent on both the filler flat structural design and the material sheet properties used to make the filler flat.

FIG. 8 is a diagrammatic illustration, without structural detail shown, of a part of the test device and an egg filler flat used to obtain flexibility matrix values. The egg filler flat is first rigidly clamped along one edge row of six cells as shown at 38. Three loading points in the opposite free edge row are then selected and designated A, B, and C as shown in FIG. 8. A 20 gram weight is then placed in one of the loading points and the deflection in centimeters at all three points is measured with a cathetometer. The loading is repeated successively at the other two points and the measurements are again taken at each of the three points. Flexibility matrix values were also obtained for the opposite edge of the egg flats by rigidly clamping one edge row of five cells and selecting load points C, D and E as shown in FIG. 8. Deflection values were then obtained by placing a 20 gram weight in these load points. A typical set of deflection results is given in Table II below.

TABLE II

| | Load at A | Load at B | Load at C |
|---|---|---|---|
| Deflection at A in cms. | 0.33 | 0.25 | 0.12 |
| Deflection at B in cms. | 0.22 | 0.21 | 0.15 |
| Deflection at C in cms. | 0.10 | 0.15 | 0.25 |

The matrix deflections should be symmetric but because of experimental error, some variation is noted. In developing the flexibility matrix F, as shown below, corresponding pairs of off-diagonal elements were averaged to minimize experimental error. For convenience, the results were expressed in terms of centimeters per kilogram weight.

$$F = \begin{matrix} f_{aa} & f_{ab} & f_{ac} \\ f_{ba} & f_{bb} & f_{bc} \\ f_{ca} & f_{cb} & f_{cc} \end{matrix} = \left(\frac{1000}{20}\right)\begin{pmatrix} .33 & \frac{.25+.22}{2} & \frac{.12+.10}{2} \\ \frac{.25+.22}{2} & .21 & .15 \\ \frac{.12+.10}{2} & .15 & .25 \end{pmatrix}$$

$$= \begin{matrix} 16.5 & 11.7 & 5.5 \\ & 10.5 & 7.5 \\ & & 12.5 \end{matrix}$$

The flexibility matrix F for each egg filler flat tested was characterized by a set of numbers like the above six numbers. While all six numbers are necessary in calculating the response of a given egg filler flat to some combined loading, they can be condensed to three numbers which will adequately characterize a given filler flat structural design, as shown below.

$$\overline{f_1} = \frac{f_{aa}+f_{cc}}{2} = \frac{16.5+12.5}{2} = 14.5$$

$$\overline{f_2} = \frac{f_{ab}+f_{bc}}{2} = \frac{11.7+7.5}{2} = 9.6$$

$$\overline{f_3} = f_{ac} = 5.5 = 5.5$$

$\overline{f_1}$ is a mean measure of the ease of deflection of a corner cell when loaded at the same corner. $\overline{f_2}$ is a mean measure of the deflection at a cell caused by loading a different, but adjacent, cell. $\overline{f_3}$ is a mean measure of the deflection at a cell of one corner caused by loading at a cell of the opposite corner. The absolute values of $\overline{f_1}$, $\overline{f_2}$, and $\overline{f_3}$ depend upon the thickness and modulus of the material in the filler flats tested as well as upon the filler flat structural design.

Finally, to reduce the absolute values of the flexibility matrix F obtained for the various filler flats tested, flexibility matrix ratios Q and R as shown below were calculated.

$$Q = \frac{\overline{f_2}}{\overline{f_1}} = \frac{9.6}{14.5} = 0.66$$

$$R = \frac{\overline{f_3}}{\overline{f_1}} = \frac{5.5}{14.5} = 0.38$$

The flexibility matrix ratios Q and R will depend primarily upon the egg filler flat structural design since the thickness and modulus effects of the egg flat material should be eliminated by taking the ratios. The theoretical upper limit of the flexibility matrix ratios Q and R is 1.0 in that Q represents the response of an egg filler flat loaded and measured at the same corner with respect to the response when the flat is loaded at a corner and measured at an adjacent loading point and R represents the response of the egg filler flat when it is loaded and measured at the same corner with respect to the response when it is loaded at one corner and then measured at the loading point of the opposite corner and therefore $\overline{f_2}$ and $\overline{f_3}$ can never be greater than $\overline{f_1}$.

Values of $\overline{f_1}$, $\overline{f_2}$, $\overline{f_3}$, Q and R for several different egg filler flats including egg filler flat examples of the present invention and several other flats of different design are listed in the following Table III. The values shown are obtained when the egg filler flats were rigidly held along one edge having a row of six cells. Additional values are included in the table for tests taken when the egg filler flat was rigidly held along one edge having a row of five cells and are designated as $\overline{f_1}'$, $\overline{f_2}'$, $\overline{f_3}'$, Q' and R'.

TABLE III

| Egg Filler Flat Samples | $\overline{f_1}$ | $\overline{f_2}$ | $\overline{f_3}$ | $\overline{f_1}'$ | $\overline{f_2}'$ | $\overline{f_3}'$ | Q | R | Q' | R' |
|---|---|---|---|---|---|---|---|---|---|---|
| 1* | 14.5 | 9.6 | 5.5 | — | — | — | 0.66 | 0.38 | — | — |
| 2* | 13.8 | 8.2 | 5.1 | 11.0 | 7.4 | 4.5 | 0.59 | 0.37 | 0.67 | 0.41 |
| 3* | 21.1 | 12.8 | 6.3 | 15.7 | 10.6 | 5.8 | 0.61 | 0.30 | 0.68 | 0.37 |
| 4* | 20.7 | 12.5 | 7.5 | 16.5 | 10.8 | 5.8 | 0.60 | 0.37 | 0.65 | 0.35 |
| 5* | 15.5 | 9.2 | 3.7 | — | — | — | 0.59 | 0.24 | — | — |
| 6* | 50.7 | 29.3 | 12.2 | — | — | — | 0.58 | 0.24 | — | — |
| 7 | 9.6 | 2.6 | −0.7 | — | — | — | 0.27 | −0.07 | — | — |
| 8 | 6.7 | 3.0 | 0.2 | 5.6 | 2.6 | 0.6 | 0.45 | 0.03 | 0.46 | 0.11 |
| 9 | 13.6 | 5.2 | 0.4 | 19.0 | 10.7 | 4.2 | 0.38 | 0.03 | 0.56 | 0.22 |
| 10 | 19.6 | 7.0 | 1.0 | — | — | — | 0.36 | 0.05 | — | — |
| 11 | 20.5 | 8.4 | 1.7 | — | — | — | 0.41 | 0.08 | — | — |
| 12 | 16.8 | 6.0 | 0.7 | — | — | — | 0.36 | 0.04 | — | — |
| 13 | 11.0 | 4.1 | 0.2 | — | — | — | 0.37 | 0.02 | — | — |
| 14 | 10.1 | 3.7 | 0.2 | — | — | — | 0.37 | 0.02 | — | — |
| 15 | 14.2 | 3.2 | −2.7 | 16.0 | 6.1 | −1.5 | 0.23 | −0.19 | 0.38 | −0.09 |
| 16 | 7.0 | 1.9 | 0.1 | — | — | — | 0.27 | 0.02 | — | — |
| 17 | 19.2 | 8.0 | 2.0 | — | — | — | 0.41 | 0.10 | — | — |
| 18 | 16.7 | 6.7 | 1.5 | — | — | — | 0.40 | 0.09 | — | — |

*Egg Filler Flat Examples of the Present Invention

As noted from Table III, the flexibility matrix ratios Q, R, Q' and R' show a substantial increased design flexibility for the egg filler flat examples of the present invention as compared to the other available egg filler flats. It has been found that in order to obtain a design flexibility satisfactory for the present invention the flexibility matrix ratios for Q and R should be about 0.5 and about 0.2, respectively, or higher. In like manner, the flexibility matrix ratios Q' and R' should be about 0.6 and about 0.3, respectively, or higher.

It is to be understood that the scope of this invention is not limited by the method of making the egg filler flat herein disclosed. It is also to be understood that the scope of this invention is not limited by the shape of the cells, number of cells or by the number of rows of cells herein disclosed. It is further to be understood that the scope of this invention is not limited by the materials used to make the egg filler flat herein disclosed or by the thickness of said material. Thus, while certain representative embodiments and details have been shown for the purpose of illustrating the invention, it will be apparent to those skilled in the art that various changes and modifications can be made therein without departing from the spirit and scope of the invention.

What is claimed is:

1. A highly flexible package useful in bulk handling, storage, and shipping of eggs or like articles comprising a generally curved undulating body member having a peripheral outer edge defining the horizontal outline of said package, said body member including a plurality of downwardly deposed cells with eggs or like articles therein, said cells grouped around a plurality of upwardly tapering support posts having transverse top walls, said cells being defined by side walls which flare upwardly and outwardly from transverse bottom walls, said side walls which are adjacent to one another interconnecting and converging into saddle formation, said posts extending above a plane defining the lowest most point of the upper surface of said saddle formations, said saddle formations curving upwardly to interconnect and converge into said posts adjacent the transverse top walls thereof and having inverted, substantially V-shaped, relatively thin cross sections which are laterally disposed and circumferentially spaced at 90° intervals around said posts, said peripheral outer edge comprising opposing substantially continuous flanges interconnecting with and directed downwardly and outwardly from the top of said posts adjacent the peripheral outer edge and transverse opposing substantially continuous flanges interconnecting with and directed upwardly and outwardly from the bottom of said cells adjacent the peripheral outer edge and having indented handle grip areas, said flanges providing strength for said peripheral outer edge without impeding the horizontal flexibility of said body member, said body member having a high flexibility attributable to the structural design thereof which deforms with a compound curvature and tends to separate adjacent eggs or like articles during rough handling, said high flexibility of said body member being defined by flexibility matrix ratios Q, R, Q′ and R′ wherein Q and R represent a degree of structural design flexibility along the sides of said body member having said indented handle grip areas, and Q′ and R′ represent a degree of structural design flexibility along the opposite sides of said body member, said flexibility matrix ratios have values of from about 0.5, 0.2, 0.6 and 0.3 or greater for Q, R, Q′ and R′, respectively.

2. The package of claim 1 wherein Q and R represent a degree of structural design along the sides of said body member having a row of six cells and Q′ and R′ represent a degree of structural design flexibility along the sides of said body member having a row of five cells.

3. A highly flexible egg filler flat for use in bulk handling, storage, and shipping eggs or like articles comprising a generally curved undulating body member having a peripheral outer edge defining the horizontal outline of said egg filler flat, said body member including a plurality of downwardly deposed cells grouped around a plurality of upwardly tapering support posts having transverse top walls, said cells being defined by side walls which flare upwardly and outwardly from transverse bottom walls, said side walls which are adjacent to one another interconnecting and converging into saddle formations, said posts extending above a plane defining the lowest most point of the upper surface of said saddle formations, said saddle formations curving upwardly to interconnect and converge into said posts adjacent the transverse top walls thereof and having inverted, substantially V-shaped, relatively thin cross sections which are laterally disposed and circumferentially spaced at 90° intervals around said posts, said peripheral outer edge comprising opposing substantially continuous flanges interconnecting with and directed downwardly and outwardly from the top of said posts adjacent the peripheral outer edge and transverse opposing substantially continuous flanges interconnecting with and directed upwardly and outwardly from the bottom of said cells adjacent the peripheral outer edge and having indented handle grip areas, said flanges providing strength for said peripheral outer edge without impeding the horizontal flexibility of said body member, said egg filler flat having a high flexibility attributable to the structural design thereof, said high flexibility of said egg filler flat being defined by flexibility matrix ratios Q, R, Q′ and R′ wherein Q and R represents a degree of structural design flexibility along the sides of said egg filler flat having said intended handle grip areas, and Q′ and R′ represents a degree of structural design flexibility along the opposite sides of said egg filler flat, said flexibility matrix ratios having values of from about 0.5, 0.2, 0.6 and 0.3 or greater for Q, R, Q′ and R′, respectively.

4. The egg filler flat of claim 3 wherein Q and R represents a degree of design flexibility along the sides of said egg filler flat having a row of six cells and Q′ and R′ represents a degree of design flexibility along the sides of said egg filler flat having a row of five cells.

5. The egg filler flat of claim 4 wherein said body member conforms to a hyperbolic paraboloid shape when loaded with eggs or like articles and supported at said handle grip areas.

* * * * *